United States Patent [19]

Potter

[11] 4,122,781

[45] Oct. 31, 1978

[54] SELF SERVICE PLANT SALES RACK

[76] Inventor: John M. Potter, 1828 S. Woodhouse, Virginia Beach, Va. 23454

[21] Appl. No.: 816,971

[22] Filed: Jul. 19, 1977

[51] Int. Cl.[2] ..... A47B 81/00

[52] U.S. Cl. ..... 108/101; 108/111

[58] Field of Search ..... 108/101, 92, 111, 108, 108/109, 27, 28; 211/191, 206, 182, 128

[56] References Cited

U.S. PATENT DOCUMENTS

| | | | |
|---|---|---|---|
| 379,261 | 3/1888 | Wright | 108/101 X |
| 1,012,242 | 12/1911 | Burns | 108/101 |
| 1,446,233 | 2/1923 | Willett | 211/128 |
| 2,648,442 | 8/1953 | Lowmaster | 108/101 X |
| 2,791,325 | 5/1957 | Schecter | 211/128 X |
| 2,919,034 | 12/1959 | Levy | 108/108 X |
| 3,272,344 | 9/1966 | Sugden | 211/191 X |
| 3,285,208 | 11/1966 | Cohen | 108/108 X |
| 3,867,048 | 2/1975 | Endzweig | 211/182 X |
| 4,018,340 | 4/1977 | Gold | 108/108 X |

*Primary Examiner*—Francis K. Zugel

*Attorney, Agent, or Firm*—Jones, Tullar & Cooper

[57] ABSTRACT

A self service rack assembly for displaying and supporting hanging basket plants and/or bedding plants and potted plants in flats or trays is disclosed. The rack is quickly and easily assembled and is supported by either suitable wheels or legs for movement into and out of a store or display area or for permanent location. The rack assembly includes various supporting uprights and interchangeable trays, support shelves, and bars so that the rack assembly can be adapted to display a single type of plant container such as hanging baskets or can be adapted to display more than one type. The rack assembly is intended for use in self service stores such as hardware, department, discount, garden stores, and similar other outlets where such containers of plants are displayed and sold.

1 Claim, 11 Drawing Figures

SELF SERVICE PLANT SALES RACK

FIELD OF THE INVENTION

The present invention is directed generally to a display rack. More specifically, the present invention is directed to a quickly and easily assembled display rack for plants in containers. Most particularly, the present invention is directed to a display rack assembly for plants which can be assembled in one of several modes to display and support either one type of plant and container or several different types of plants and containers.

The display rack assembly in accordance with the present invention is comprised generally of supporting uprights which are connected to each other by an array of horizontal bars and/or shelves and/or pans. Plants in hanging baskets can be supported from the bars and bedding or potted plants in flats or trays can be placed on the shelves or trays. The rack assembly can either be placed on wheels or can be supported on suitable legs for stationary positioning. The rack assembly is quickly converted from one type of display to another thereby providing a plant display and storage rack which can be used throughout the year even as the type of plant and container being sold changes.

DESCRIPTION OF THE PRIOR ART

The display and sales of various plants in a number of different containers has become increasingly popular. The type of plant container known as a hanging basket is an example of the type of plant container which is currently quite popular. In addition, flats or trays of bedding plants, potted plants, and the like are displayed and sold in a number of stores. Decorative indoor and outdoor flowering plants and small bushes, as well as food producing plants such as tomato plants, are in vogue and may be seen on display and offered for sale in a number of retail outlets such as hardware, department, discount, drug, garden, food, and other stores as well as at open air markets and fairs.

The variety of makeshift racks and supports for displaying these plants is limited only by the ingenuity of the person charged with their display and by the available materials. Cinder blocks and boards, converted baking products racks, wooden shelfing and the like are currently being utilized to display flats and trays of bedding and potted plants. Hanging baskets of plants are hung from rafters, supported on converted dress racks, strung on wires and, as with the flats or trays, merely placed on the ground.

The currently utilized means for displaying and storing the various plants and their containers suffer from a number of shortcomings. Perhaps the foremost of these is the generally unappealing nature of the display. A customer is more inclined to purchase a product where it is presented to him in an appealing manner. A display of plants on make-shift racks or spread about on the ground or the like is apt not to be a particularly appealing display. If it is inconvenient to view or examine an item, he is less apt to buy. The currently utilized displays are often both unattractive and difficult to use.

A second problem with current display means is one of flexibility. Different types of plants are sold during various times of the year and a rack assembly should be capable of displaying and supporting these various plants in their containers. Again, the arrangements currently being used, since they are makeshift or adapted from other usages, are not capable of being readily and easily converted from one display mode to another so that the rack assembly can be used throughout the year.

Another problem with current display and storage means is one of transportability. For reasons of both plant health and for viewing the plants in a somewhat natural setting, the plants are quite often moved outside during store hours but must be returned within the store when the store is closed. Pilferage is apt to occur if the plants are left out, yet the daily shifting of the plants out of and back into the store is so difficult with present methods of display that the plants are often left out and stolen.

A further problem is that in some climates plants can be brought outside during only part of the year and must stay inside the rest of the time. Thus, a rack which can be movable during part of the year but which is capable of being rendered unmoving during other times is desirable. The currently available devices lack such a capability.

SUMMARY OF THE INVENTION

It is an object of the present invention to provide a self service plant sales rack which is appealing to customers.

Another object of the present invention is to provide a plant rack which is quickly and easily converted from one display mode to another.

Yet a further object of the present invention is to provide a plant rack which may be provided with wheels or casters to allow movement thereof.

Still another object of the present invention is to provide a plant rack wherein the rack can quickly and easily be made stationary.

As will be set forth in greater detail in the description of preferred embodiments, the rack assembly in accordance with the present invention is comprised generally of at least a pair of spaced upright supports which are joined together by a plurality of generally horizontal plant container support members. These horizontal support members can be bars for supporting plants in hanging baskets, can be wire mesh shelves for supporting flats of bedding plants or trays of potted plants, or can be pans for supporting individual plants in containers, or for containing excess water used in watering the plants. The rack assembly can be assembled with all of one type of support member or with several different support members, as the array of plants to be displayed requires. The rack assembly can be provided either with wheels or with feet depending on whether the rack is intended to be movable or to remain stationary. The rack assembly components are provided with quickly attaching connections so that assembly and changing of the rack can be accomplished quickly and easily. The rack assembly can be assembled in varying lengths, as desired.

As discussed previously, the prior means utilized to display and store various plants have been haphazard at best. In contrast, the self service plant sales rack assembly in accordance with the present invention provides a rugged, durable, attractive and adaptable structure which is intended specifically for the display and storage of plants in containers. This rack assembly is adaptable to support various plants in differing containers, is quickly changed from one mode to another, can be provided with wheels for ease in transportation or with feet for stationary positioning, and is an attractive and functional assembly which overcomes the difficulties discussed in connection with the prior devices.

DESCRIPTION OF THE DRAWINGS

While the novel features of the present invention are set forth with particularity in the appended claims, the invention will be understood more fully and completely from the detailed description of the preferred embodiments of the invention and as seen in the accompanying drawings in which:

DESCRIPTION OF PREFERRED EMBODIMENTS

Figure 1:
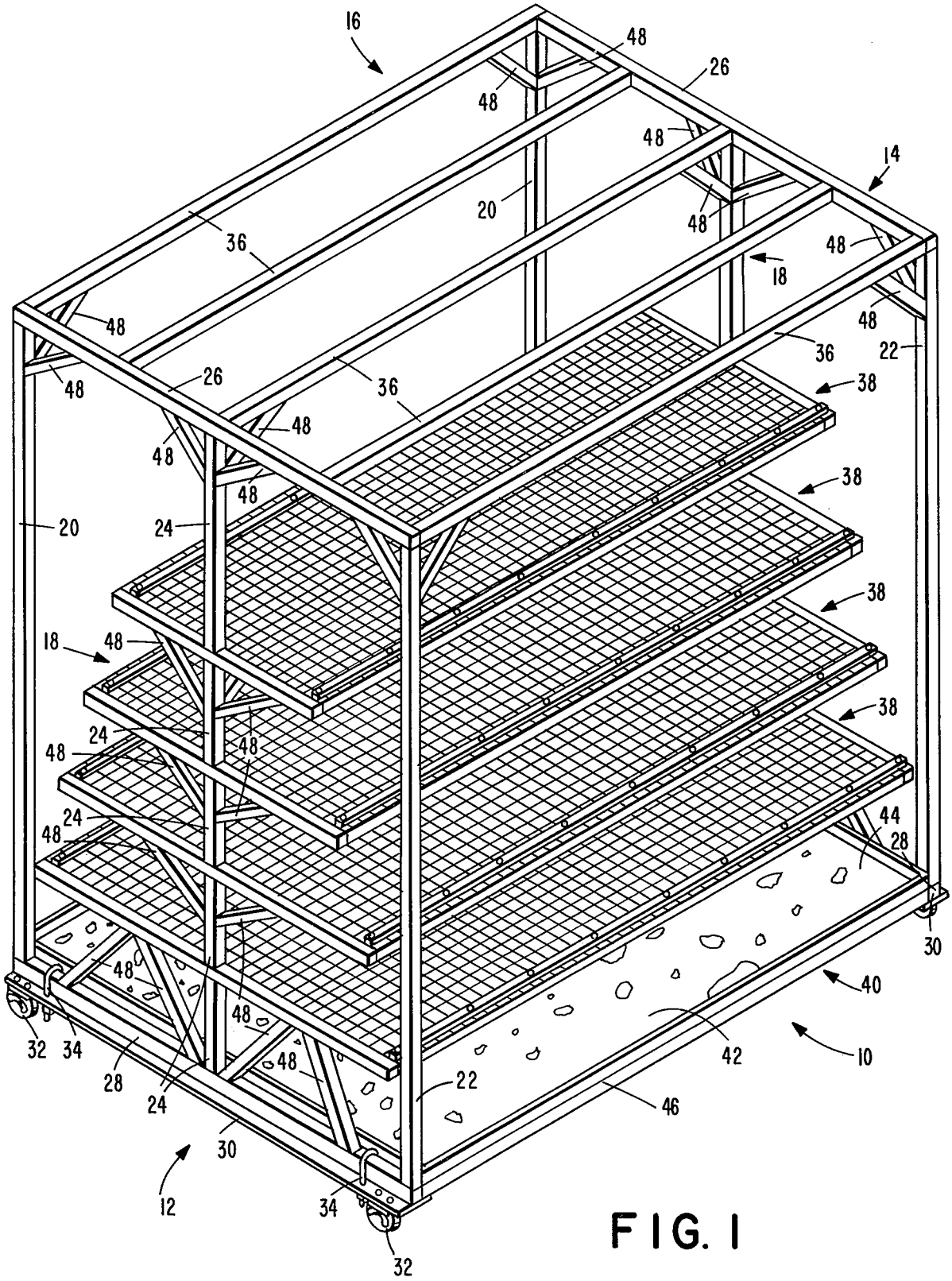
FIG. 1 is a perspective view of a first embodiment of a plant rack in accordance with the present invention.

Turning now to FIG. 1, there may be seen generally at 10 a first preferred embodiment of a self service plant sales rack in accordance with the present invention. Rack assembly 10 is comprised generally of a pair of spaced upright support sections 12 and 14 which are joined together by a plurality of horizontal plant container support members 16. As will be discussed in more detail hereinafter, rack assembly 10, as well as the several other embodiments to be discussed, is intended to be quickly and easily assembled and taken apart. The various sections, which can be put together in a plurality of modes to form racks of varying lengths and widths, are provided with cooperating fastening means and the various plant support members are interchangeable with each other. While the preferred material used in the rack assemblies is steel, it will be obvious that a number of alternate types of materials could be used, if desired. It will also be obvious that the arrangement of plant container support members shown in FIG. 1 and the several other embodiments could be varied, if desired.

Returning to FIG. 1, it may be seen that each of the upright support sections 12 and 14 is comprised of a main upright column, generally at 18, and a pair of peripheral upright columns 20 and 22. In the preferred embodiment these columns and the additional similar members are of 1 inch square steel tubing of 1/16 inch wall thickness. Main upright column 18 is, as may be seen in FIG. 1, formed by a plurality of shorter tubular sections 24. These tubular sections 24 extend between horizontal support sections of the rack assembly and are joined thereto by suitable fastening means, as will be discussed in more detail hereinafter. Top and bottom cross bars 26 and 28 extend beween the main and peripheral upright columns and together with these upright columns form the upright support sections. A flat plate 30 of generally the same length as cross bar 28 has suitable wheels or casters 32 secured thereto at end portions of the plate and plate 32 is secured to bottom cross bar 28 by suitable means such as U bolts 34. Thus, each upright support section 12 and 14 can be provided with wheels so that rack assembly 10 can be moved about as desired.

As may also be seen in FIG. 1, the horizontal plant container support members generally indicated at 16 are comprised of elongated hanger bars 36 which extend between the spaced, top cross bars 26 of the two upright support sections 12 and 14; wire screen shelves 38, which also extend between the upright support sections 12 and 14 and which are supported between tubular sections 24 of the main upright column 18; and a pan 40 which has a generally flat bottom 42 and upstanding side walls 44. Pan 40 is provided with pan support tubes 45 which contact the flat plate 30 and which are secured to the bottom cross bars 28. As may be seen in FIG. 1, pan 40 is as wide as the upright support sections and the shelves 38 are of decreasing widths so as to form a generally trapezoidal or stepped array when rack assembly 10 is put together.

In use, the rack assembly is put together using the fastening means as will be discussed hereinafter, and various plants in containers are put on the rack. Plants in hanging baskets are supported by bars 36 with the usually provided hook on the basket hanger passing around the elongated bars 36. If the basket hanger is of rope such as macrame or the like, a small hook (not shown) can be attached to bar 36 and the plant basket hanger secured to the hook. The shelves 38 and pan 40 are used to place flats and trays of bedding and potted plants or the like thereon. Since pan 40 is wider than the several shelves 38 and is provided with a solid bottom, water can be given to the various plants and any excess will be retained in the pan 40 which can, if desired, be provided with a drain means (not shown) to remove any excess water which might collect. Depending on the load which is to be placed on the shelves and hanger bars, suitable angle braces 48 can be placed in various locations as needed. Several sizes and lengths of braces can be supplied with each rack assembly and are intended to be utilized as needed to give additional stiffness and support to the rack assembly 10 if needed. It will thus be seen that rack assembly 10 as shown in FIG. 1 can be used to display and store plants in hanging baskets, in flats, and in trays. The rack assembly is capable of being rolled about and provides a mobile, attractive, sturdy display and self service sales rack.

Figure 2:
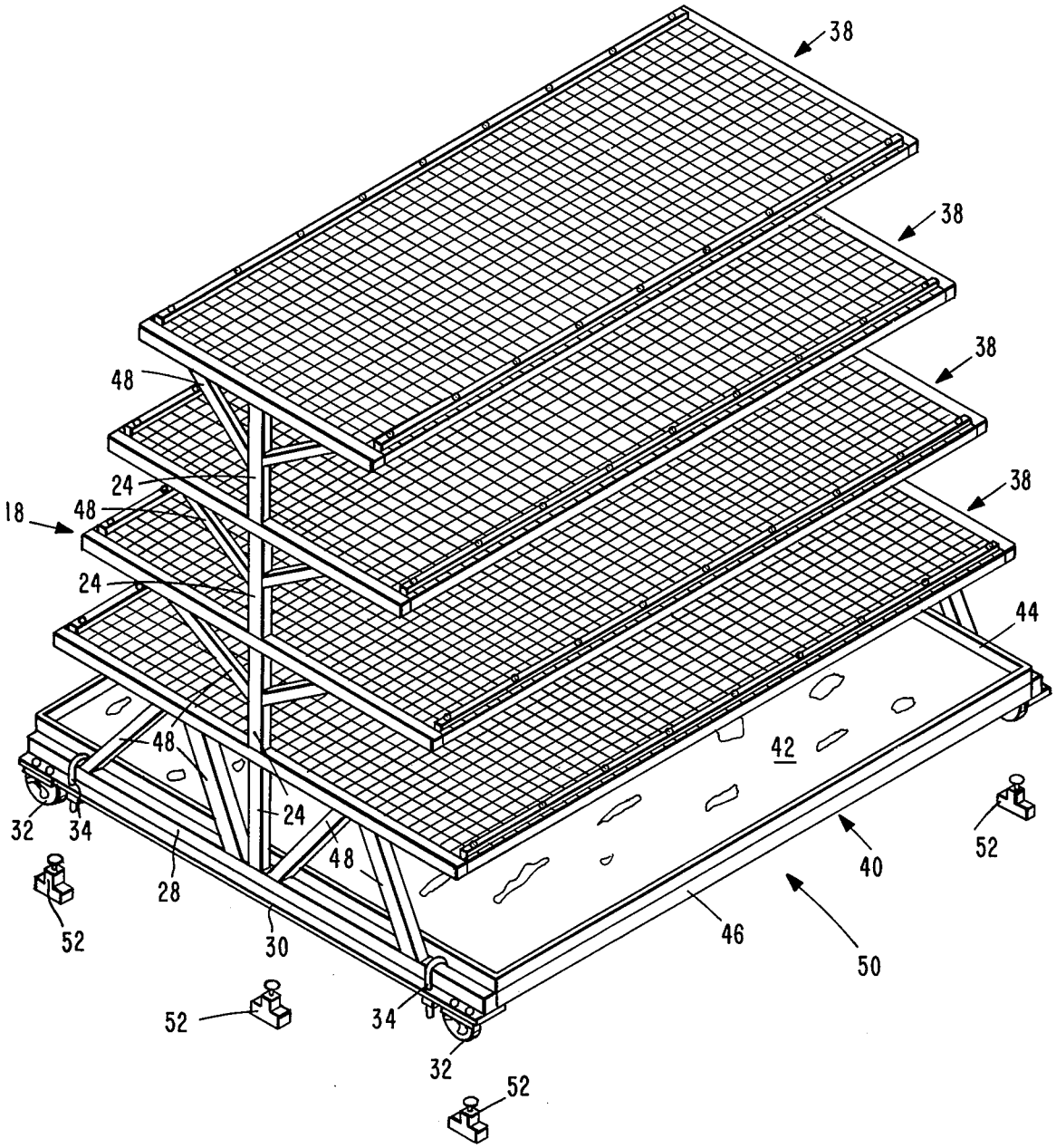
FIG. 2 is a perspective view of a second embodiment of a plant rack in accordance with the present invention.

A second embodiment of a rack assembly, generally at 50, is shown in FIG. 2. It will be obvious that rack 50 is generally similar to rack 10 except that the peripheral upright columns 20, 22, the top cross bars 26, and the elongated hanger bars 36 of rack assembly 10 have been removed from rack assembly 50. The remainder of rack assembly 50 is the same as rack assembly 10 and is similarly numbered. Rack assembly 50 is shown as having four shelves 38 and a single bottom pan 40. However, this rack as well as rack 10 and the racks yet to be described could as easily have four pans 40 and only one shelf 38 or any other combination which might be desired. In addition, the total number of pans and shelves need not be the five as shown but can also be varied as dictated by the plants being stored and displayed.

As may also be seen in FIG. 2, rack assembly 50 can be supported by feet 52 which can be attached to bottom cross bar 28 once plate 30 and wheels 32 are taken off by removing the U bolts 34. Feet 52 are shown as being generally of an inverted T shape but could be of any suitable size and shape. Several different styles of supporting feet could be provided, for example, with differing sizes of surface area if the rack assembly is to be placed on soft ground or on a hard floor. It will again be understood that support feet 52 can be used with any one of the embodiments of the subject invention and are not limited to use only with rack 50.

Figure 3:
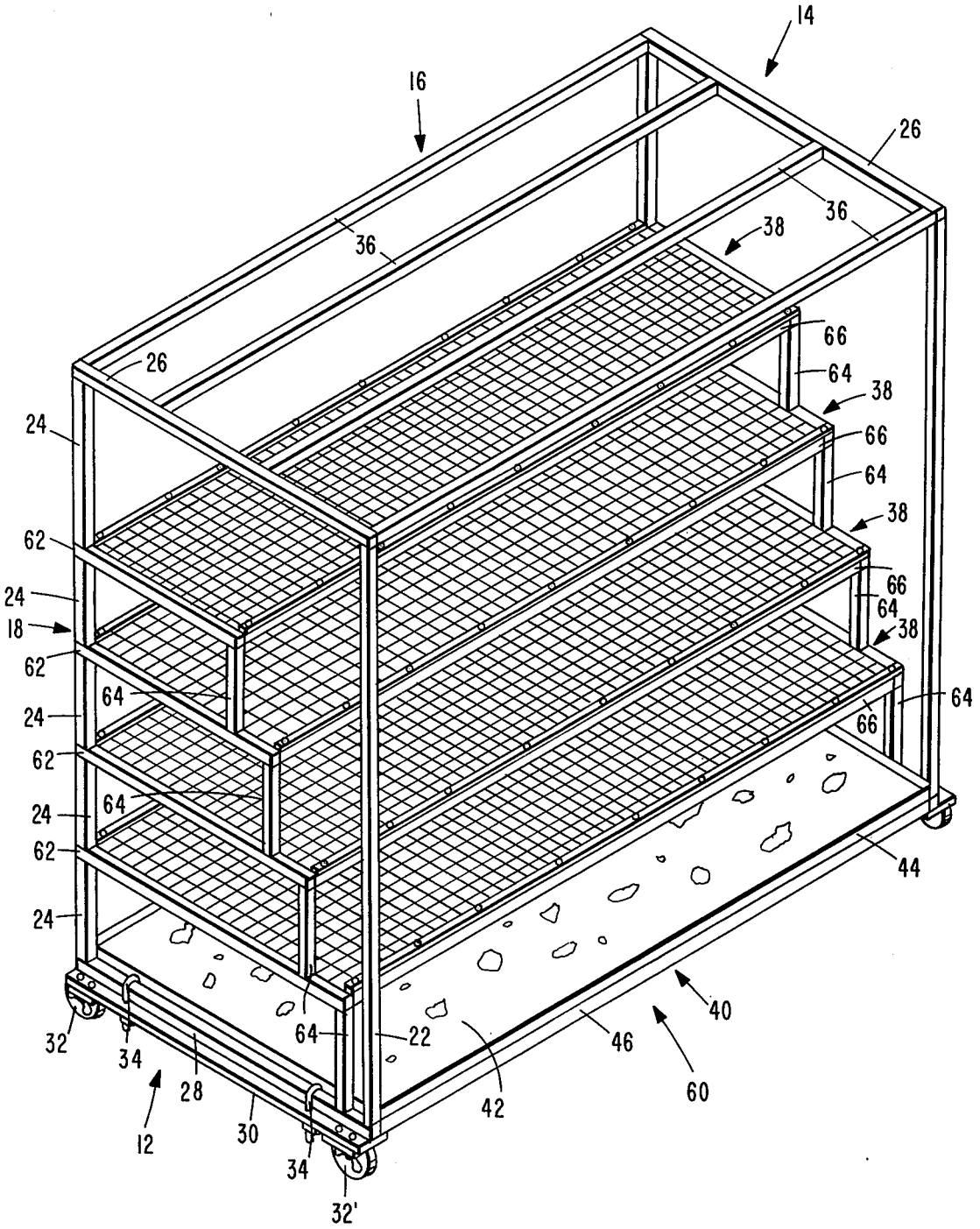
FIG. 3 is a perspective view of a third embodiment of a plant rack in accordance with the present invention.
Figure 4:
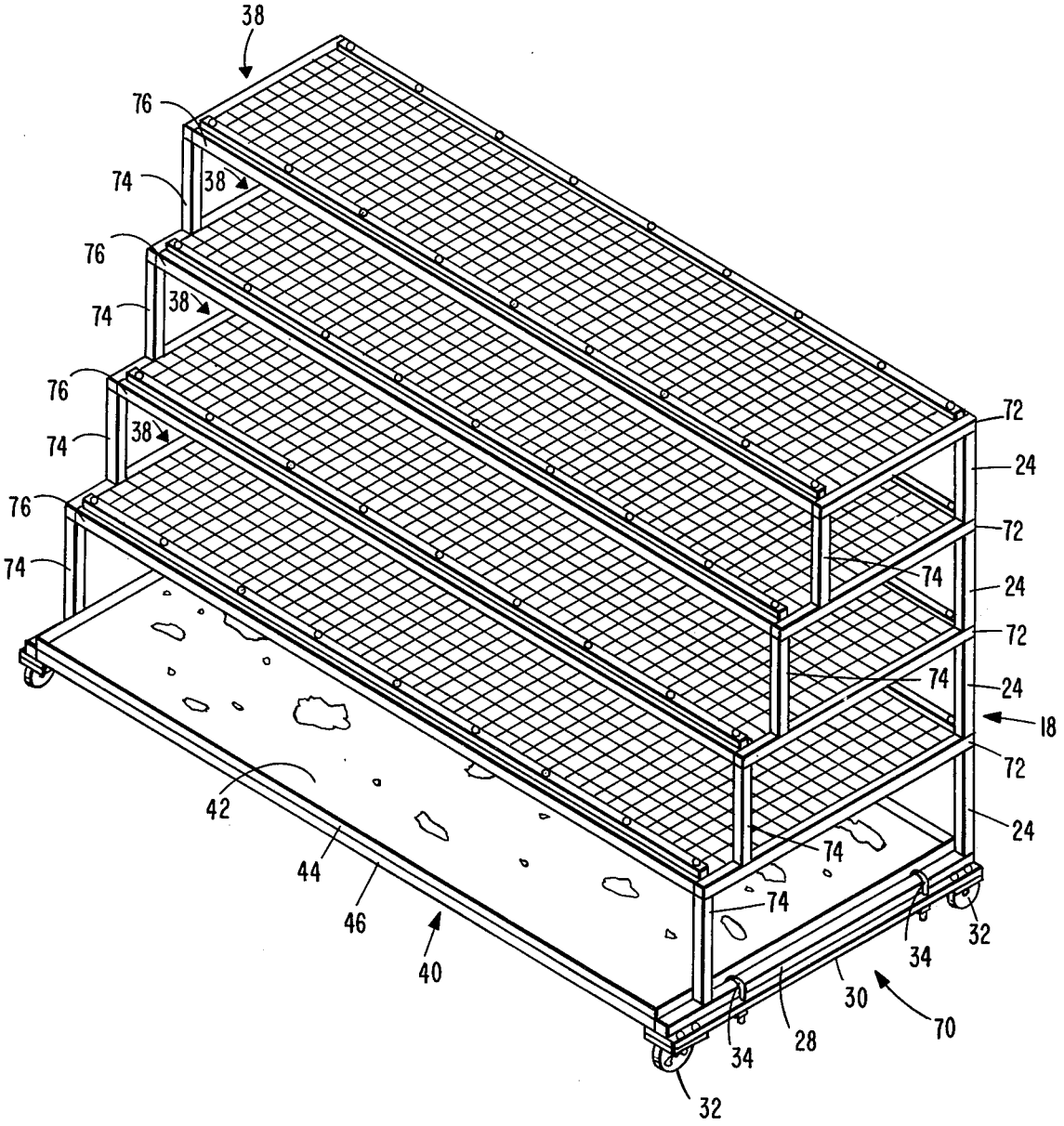
FIG. 4 is a perspective view of a fourth embodiment of a plant rack in accordance with the present invention.

Turning now to FIGS. 3 and 4, there may be seen generally at 60 and 70 third and fourth embodiments, respectively, of a self service plant sales rack in accordance with the present invention. Racks 60 and 70 are each generally half as wide as corresponding racks 10 and 50 and are intended for use in areas where there is not adequate space to use a rack such as shown in FIGS. 1 and 2. Rack assembly 60 of FIG. 3 is generally the same as one half of rack assembly 10 of FIG. 1, and rack assembly 70 of FIG. 4 is generally the same as one half of rack assembly 50 of FIG. 2. Similar portions of these racks are given similar numbers. In both rack assemblies 60 and 70, the main upright column 18 is formed of tubular sections 24 similarly to the construction of racks 10 and 50. However, since the main upright column supports the edge or corner 62, 72 of a shelf 38 in racks 60 and 70, respectively, it is desirable to provide upright braces 64, 74 to aid in the support of the outboard edges 66, 76 of the shelves 38 of rack assemblies 60 and 70. As with the previously described rack assemblies, the comparative number of shelves and pans is merely exemplary and various other arrangements could be utilized as desired. Both racks 60 and 70 are shown having wheels or casters but feet could be substituted for these as was discussed in connection with FIG. 2.

Figure 5:
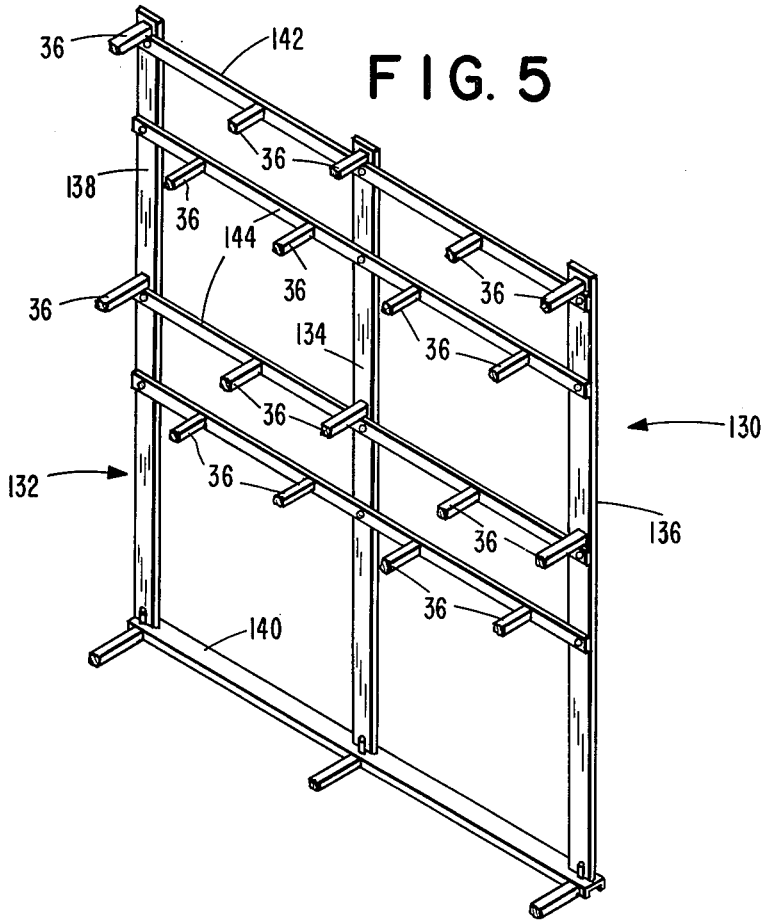
FIG. 5 is a perspective view of a portion of a fifth embodiment of a plant rack in accordance with the present invention.

In FIG. 5 there may be seen a portion of a fifth embodiment of a rack assembly 130 in accordance with the present invention. A plurality of elongated hanger bars 36 extend between a pair of similar upright support sections 132, only one of which is seen in FIG. 5. Each upright support section 132 is generally similar to the prior embodiments and includes a main upright column 134 and a pair of peripheral upright columns 136 and 138. These columns are secured to a bottom cross bar 140 by suitable means to be discussed in detail hereinafter. Suitable wheels, casters, of feet (not shown) can be attached to each upright support section 132 similarly to the wheels, casters or feet discussed in the several other embodiments. A top cross bar 142 and several intermediate cross bars 144 are included in each upright support section and the elongated hanger bars 36 can be attached to the main and peripheral upright columns and to the various cross bars to form a rack assembly for use primarily with hanging baskets. It will be understood that in this, as well as the several other previously described embodiments, the length of the assembled rack can be varied as desired by combining individual units, thus providing a rack assembly having any desired length.

Figure 6:
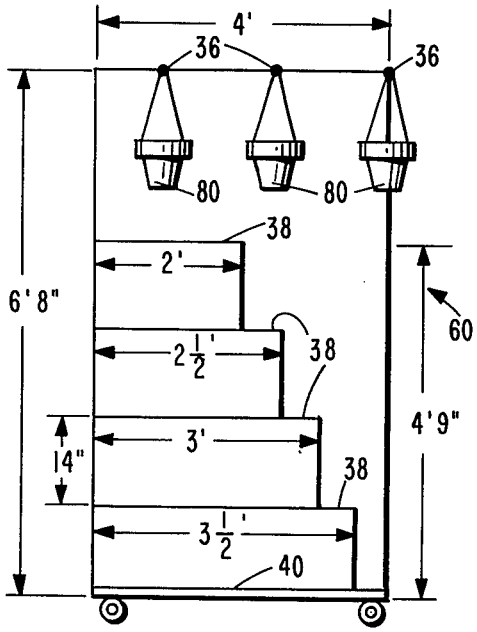
FIG. 6 is a schematic side elevation view of the plant rack of FIG. 3 and showing the general dimensions of the rack assembly.

In FIG. 6 there is shown a schematic side view of the rack assembly 60 of FIG. 3. As may be seen from FIG. 6, this rack assembly is approximately 7 feet high and 4 feet deep. A number of hanging baskets 80 are shown schematically and are hung from the elongated hanger bars 36 by any suitable means. While not specifically shown, it will be understood that the shelves 38 and the pan 40 would in actual usage be carrying a variety of flats and trays of plants which would be easily transported from place to place and which would be in easy reach and accessible to customers. The dimensions shown in FIG. 6 are only exemplary of one embodiment of the rack assembly and should not be viewed as indicative of the only size of rack assembly which could be constructed in accordance with the present invention.

Figure 7:
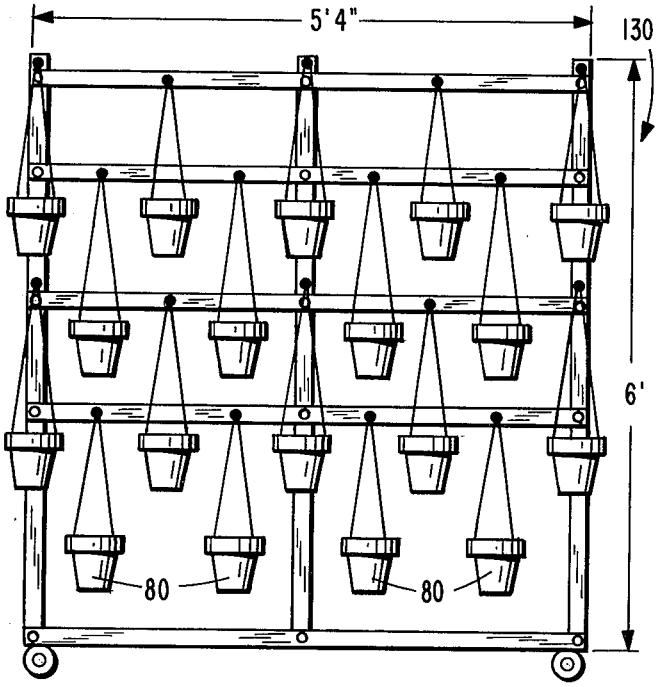
FIG. 7 is a schematic side elevation view of the plant rack of FIG. 5 and showing the general dimensions of the rack assembly.

A schematic side view of the rack assembly of FIG. 5 is set forth in FIG. 7. As in FIG. 6, the dimensions shown are only exemplary and could be varied as desired to produce racks of differing lengths and widths. Since rack assembly 130 is intended primarily for hanging baskets 80, it is shown supporting only these. If desired, rack 130 could also be provided with screens and/or pans. As may be seen in FIG. 7, baskets 80 are supported by the elongated hanger bars in an offset array so that each basket is not directly above or below another. This facilitates both the display of the plants and access thereto by customers.

Figure 8:
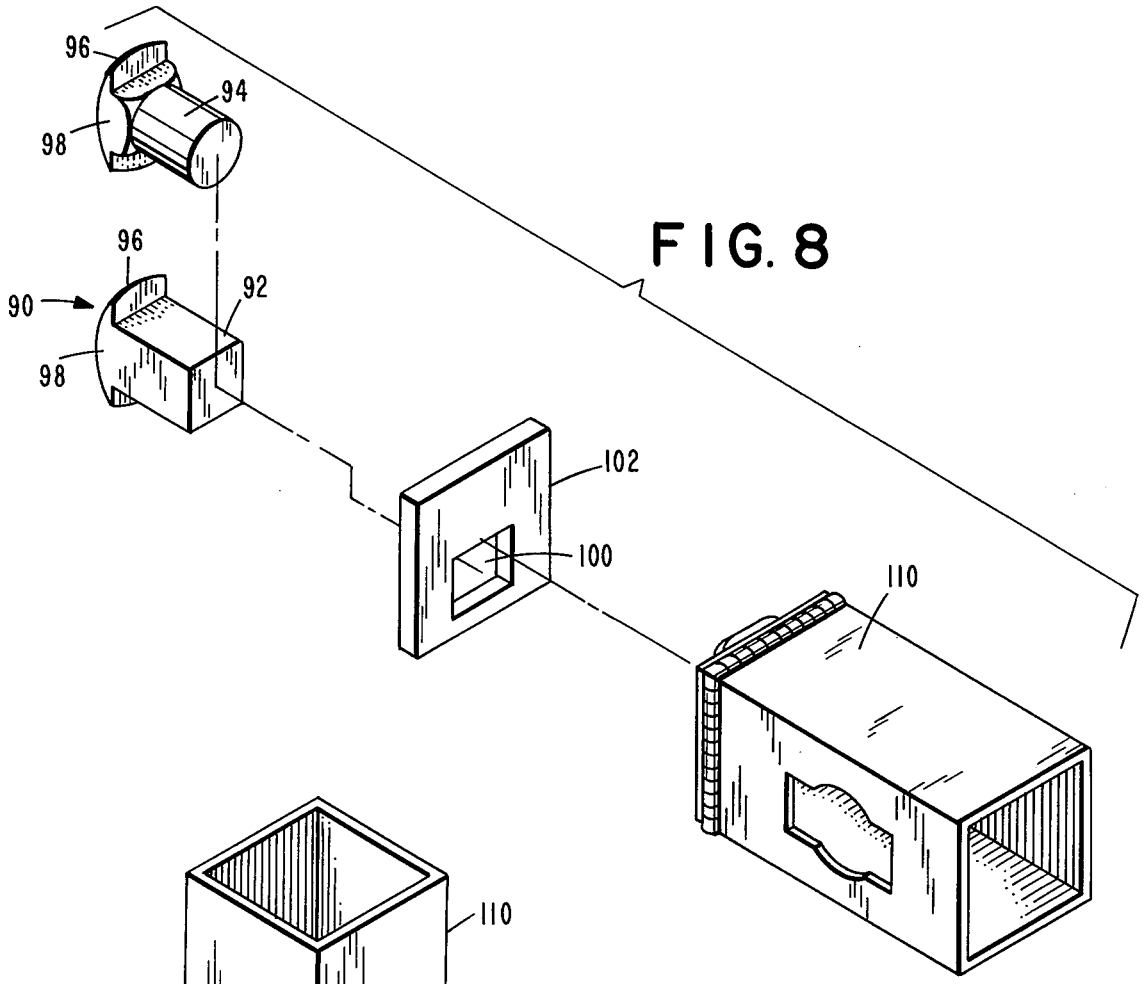
FIG. 8 is a perspective view of two alternate fastening means for securing the rack assembly together.
Figure 9:
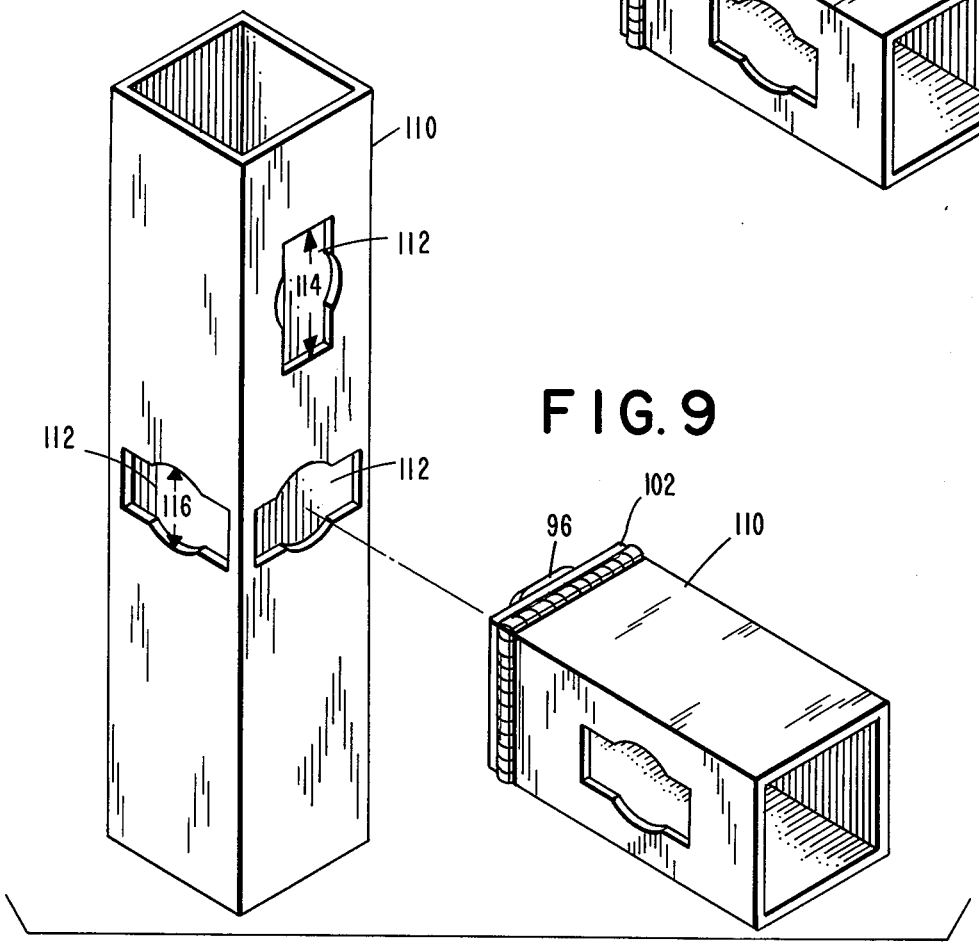
FIG. 9 is a perspective view of one embodiment of typical structural members in accordance with the present invention.

Referring to FIGS. 8 and 9, there may be seen a fastening means which can be used to secure the various sections of the rack assemblies of FIGS. 1–4 together. Turning first to FIG. 8, there is shown at 90 two variations of a fastener stud. Stud 90 is comprised of an elongated shank portion which may be rectangular as at 92 or generally circular as at 94. An enlarged head portion 96 is secured to one end of each shank 92, 94 with the head portion 96 being formed as a circle having parallel cord sections removed to leave a somewhat oval head with parallel flat sides 98. These fasteners are positioned in an offset hole 100 in a flat square plate 102 of metal which is in turn secured to an end or side of a section of the steel tubing of which the rack assembly is made. There is a space left between the head 96 of fastener 90 and the flat square metal element 102 so that the head 96 is spaced away from the square 102 a distance slightly greater than the thickness of the steel tubing being used.

As may be seen in FIG. 9, the steel tubing 110 is provided with a plurality of apertures 112 having a width greater than that of the head 96 of the fastener 90 and a major length 114 greater than the length of head 96 and a minor length 116 less than the length of head 96 of fastener 90. The head 96 may be inserted into aperture 112 and rotated 90° so that it cannot be removed. It will further be understood that, while the steel tubing shown in FIGS. 1–5 does not show a plurality of apertures 112, these apertures are part of the entire assembly and are not so shown merely for ease in drawing. All of the steel tubing elements are provided with an array of apertures into which the fastener heads are insertable so that the rack assembly can be quickly and easily assembled and taken apart.

Figure 10:
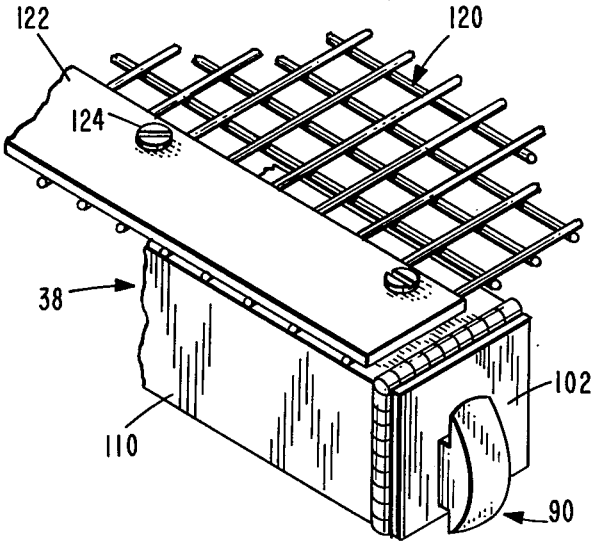
FIG. 10 is a perspective view of a portion of a wire shelving support member in accordance with the present invention.

A typical means of forming one of the wire screen shelves 38 is shown in FIG. 10. As may be seen, a typical section of steel tube 110 which has a fastener 90 attached to a flat square metal plate 102 which is in turn welded to tube 110 has a section of wire screen 120 secured to it by use of steel strapping 122 which is secured to tube 110 by suitable means such as screws 124. The screening is held in place between the strapping 122 and the tube 110 yet can be replaced if it is damaged or destroyed. It will be understood that this means of forming shelf 38 is merely exemplary of any number of ways in which a suitable section of steel screen could be secured to a tube frame.

Figure 11:
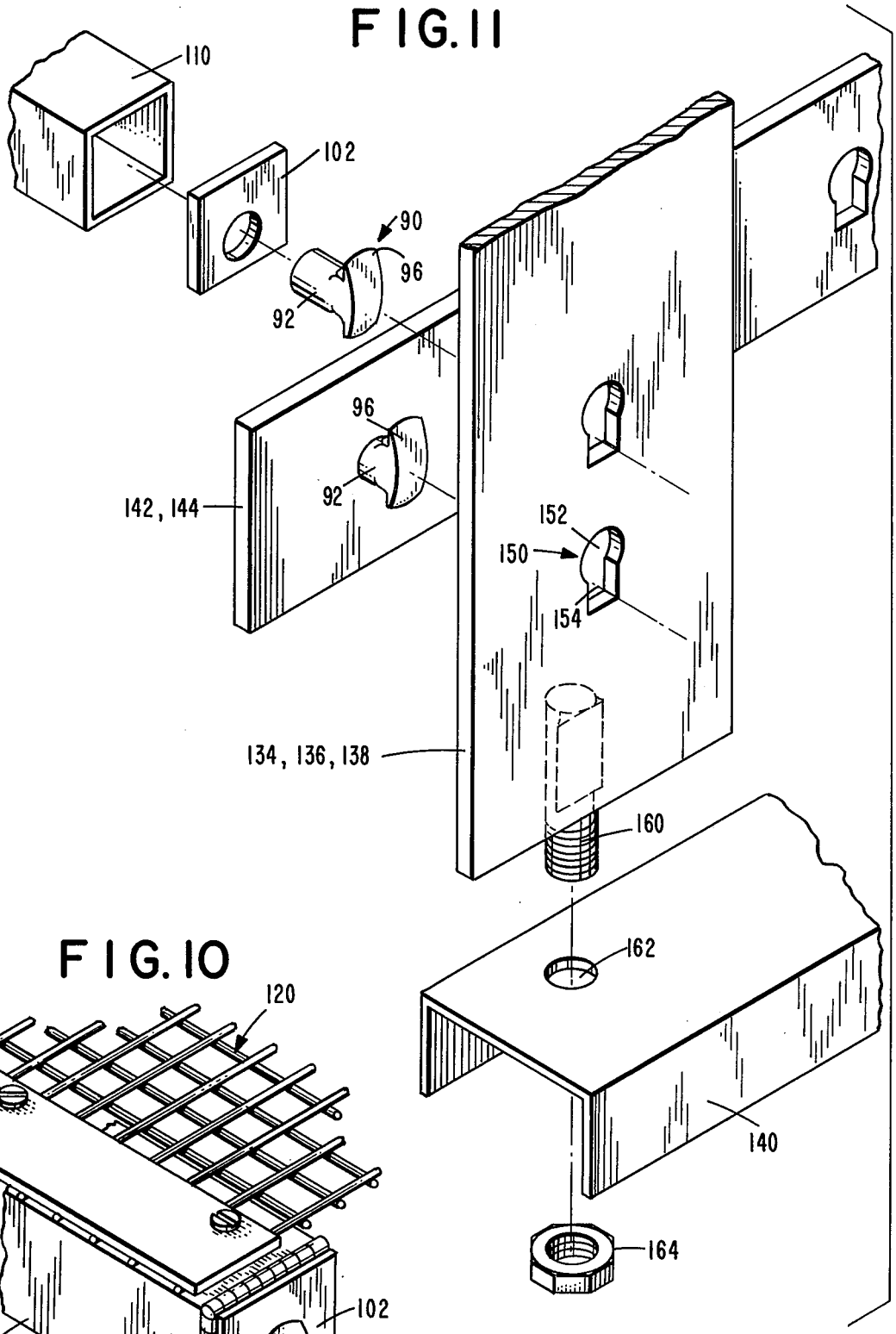
FIG. 11 is a perspective view of a third alternative fastening means for securing the rack assembly of FIG. 5 together.

In FIG. 11 there is shown a further embodiment of an assembly system for use particularly with the hanging basket rack as shown in FIG. 5. Each of the upright columns 134, 136, 138 is provided with a plurality of apertures 150 each of which has an enlarged, generally circular head portion 152 and a downwardly depending rectangular slot 154. The enlarged head portion 96 of a fastener stud 90 is inserted into aperture 150 and the shank 92 of the fastener drops into the slot portion 154 of the aperture. As may be seen in FIG. 11 both the rectangular tubing 110 used to form the elongated hanger bars 36 and the flat steel used to form the top and intermediate cross bars are provided with fasteners and both the cross bars and upright columns are provided with apertures. Suitable bolts 160 are attached to the lower portions of upright 134, 136, 138 and pass through corresponding holes 162 in bottom cross bars 140 to be secured in place by suitable nuts 164. As with the several other embodiments, it will be understood that a number of generally similar fasteners and the like could be used to secure the sections of the rack assembly together and that any such means is suitable so long as it provides ease in assembly yet is strong and durable.

While five embodiments of a self service plant sales rack in accordance with the present invention have been hereinabove fully and completely described, it will be understood that these embodiments are not to be construed as limiting the invention but rather as presenting five specific structural embodiments thereof. The invention is directed to a quickly assembled, movable plant sales rack which is capable of being adapted to display and store plants in one or more types of containers at the same time. The specific number of shelves as opposed to pans or hanger bars is not as important as is the more general aspect of providing a rack structure which can provide all three of these supports in variable quantities at the same time in one rack. It will be obvious to one of ordinary skill in the art that a number of changes in, for example, the size of the rack assembly, the number of shelves, pans and hanger bars, the shape of the tubular members, the manner of attaching the wheels or casters and the like could be made without departing from the true spirit and scope of the invention and that, therefore, the invention is to be limited only by the following claims.

I claim:

1. A self service plant sales rack assembly for displaying and storing a plurality of different plants in containers, said rack assembly comprising:

at least first and second upright support sections, each of said sections including a main upright column and at least one peripheral upright column, said main and peripheral upright columns on each of said upright support sections being joined at an upper portion by a top cross bar;

a plurality of generally horizontal plant container support members, uppermost ones of said horizontal support members being elongated hanger bars extending between said top cross bars of adjacent ones of said upright support sections, a bottommost one of said horizontal support members being a pan having a solid bottom and upraised sides and extending between said upright support sections, and intermediate horizontal shelves extending between said upright support sections and below said hanger bars and above said pan, at least one of said intermediate horizontal shelves being a screened shelf, said shelves being placed in a step-like array;

means for releasably securing said upright support sections and said container support members together to form said sales rack assembly; and means for releasably securing wheels to lower portions of said upright support sections whereby said rack assembly may be movable.

* * * * *